US005921825A

United States Patent [19]

Larsson

[11] Patent Number: 5,921,825

[45] **Date of Patent: *Jul. 13, 1999**

[54] HIGH SPEED BOAT

[76] Inventor: Lars Larsson, Borstbindargatan 8, Kristinehamn, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/556,942

[22] PCT Filed: Jun. 3, 1994

[86] PCT No.: PCT/SE94/00539

§ 371 Date: May 13, 1996

§ 102(e) Date: May 13, 1996

[87] PCT Pub. No.: WO94/29169

PCT Pub. Date: Dec. 22, 1994

[51] Int. Cl.[6] ..... B63H 11/08; B63H 11/113

[52] U.S. Cl. ..... 440/38; 440/42

[58] Field of Search ..... 440/38, 40–43, 440/67, 68, 48; 60/221

[56] References Cited

U.S. PATENT DOCUMENTS

| | | | |
|---|---|---|---|
| 1,759,511 | 5/1930 | Kort | 440/38 |
| 3,198,158 | 8/1965 | Winter . | |
| 3,977,353 | 8/1976 | Toyama | 440/38 |
| 5,181,868 | 1/1993 | Gabriel . | |

FOREIGN PATENT DOCUMENTS

| | | | |
|---|---|---|---|
| 175596 | 7/1989 | Japan | 440/38 |
| 405058390 | 3/1993 | Japan | 440/38 |
| 9420362 | 9/1994 | WIPO | 440/38 |

*Primary Examiner*—Sherman Basinger
*Attorney, Agent, or Firm*—Howrey & Simon; Michael J. Bell; Timothy W. Riffe

[57] ABSTRACT

High speed boats can be operated and steered by a water jet which is generated by a pump, the shaft of which is directly coupled to a driving motor. According to the invention, the engine shaft and the pump hub shaft are parallel to each other and a driving belt is placed over the motor shaft and the peripheral ring of the pump.

6 Claims, 2 Drawing Sheets

HIGH SPEED BOAT

BACKGROUND OF THE INVENTION

The present invention refers to a high speed boat in which is used a pump driven by a driving motor constituted by for instance a petrol engine or a diesel engine. The pump pumps up water and generates a jet which can be directed and given different pressures, whereby such a boat can be propelled at a high velocity. Known boats has the driving motor directly coupled to the shaft of the pump and this has among other things the drawback that it becomes necessary to sometimes use a gear-box between the motor and the pump shaft. Further the shaft that drives the pump gives rise to certain flow problems.

SUMMARY OF THE INVENTION

The object of the present invention is to create a high speed boat of aforementioned type in which a gear-box can be dispensed with and where the pump can be operated continuously. According to the invention this is made possible by the pump shaft being arranged parallel to the driving shaft of the engine and these two shafts located at a distance from each other. Directly on the driving shaft or on a wheel located on the driving shaft a driving belt is applied, which is placed over the external peripheral ring of the pump wheel. As mentioned the use of a gear-box thereby is avoided and further water flow disturbances of a driving motor shaft interconnected with a pump shaft are eliminated.

According to an advantageous embodiment of the present invention the peripheral ring of the pump is applied outside the stern of the boat and the same applies to the free end of the shaft of the driving motor so that the driving arrangement of pump ring, driving belt and engine driving shaft are located completely outside of the boat and form a single unit.

According to an advantageous embodiment of the invention the pump ring, the driving belt and driving shaft wholly or partly are encapsulated in a protection housing.

Further features concerning the present invention appear from the subsequent claims.

BRIEF DESCRIPTION OF THE DRAWINGS

The present invention will be described in closer detail in connection with two drawings enclosed, in which.

DETAILED DESCRIPTION OF THE INVENTION

Figure 1:
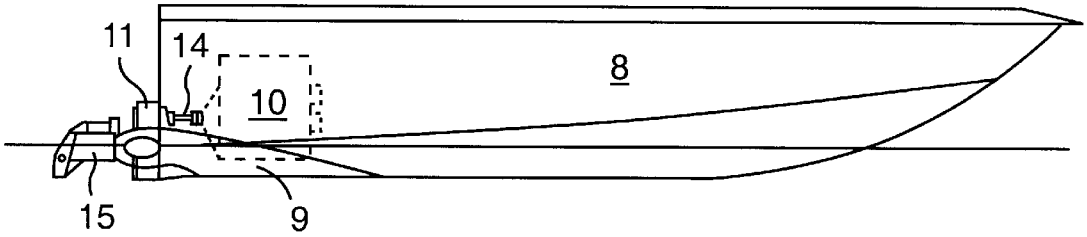
FIG. 1 shows a lateral view of the high speed boat.
Figure 2:
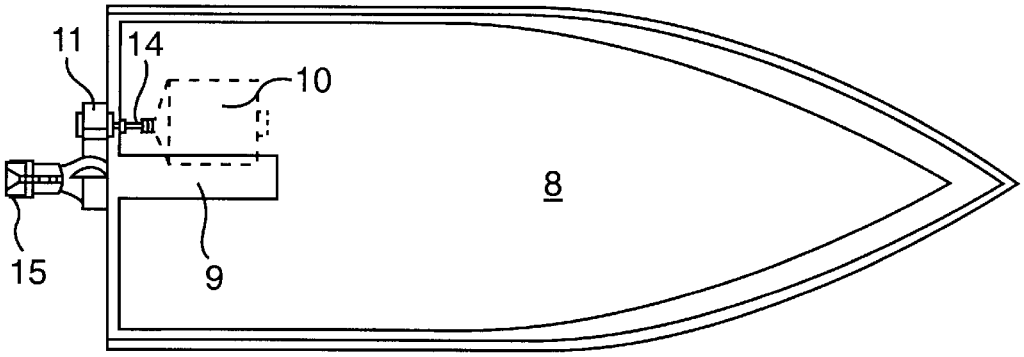
FIG. 2 shows the same boat seen from above.
Figure 3:
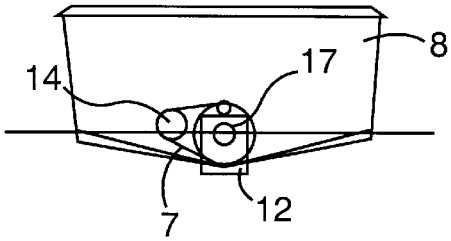
FIG. 3 shows the stern of the boat according to the preceeding figures.
Figure 4:
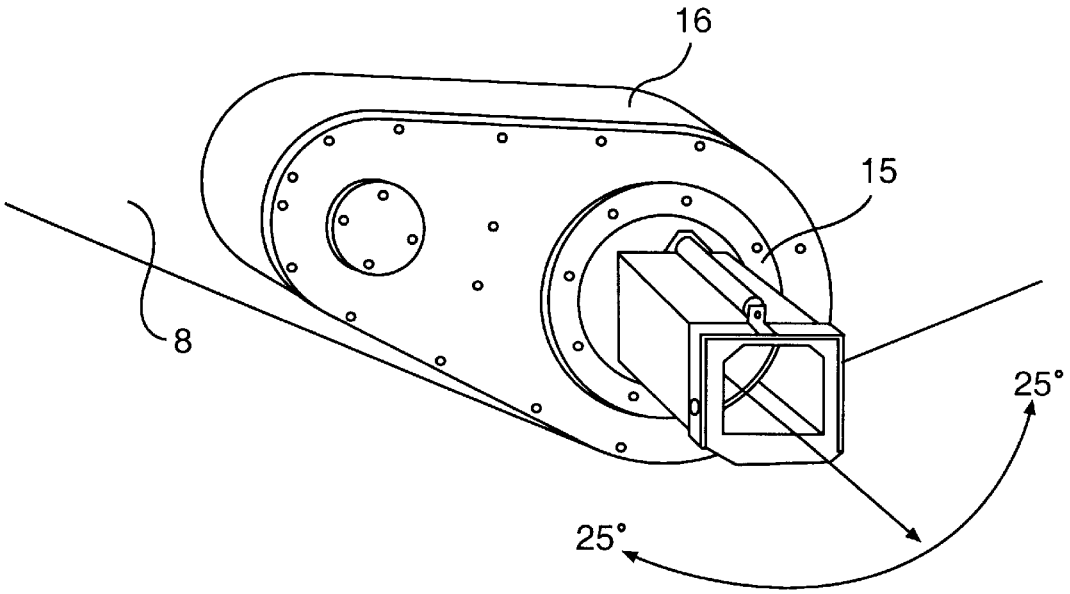
FIG. 4 shows an encapsulated driving arrangement.

In the figures the designation 8 refers to a high speed boat which contains a driving motor 10 and drives a pump shaft 17 with an adjustable outlet nozzle 15. The boat is arranged with a water intake 9 that provides the pump with water. As clearly and distinctly appears from of FIG. 3 as the rear end of the pump 11 is shown, where a driving belt 7 is placed over the peripheral ring of the pump and the driving shaft 14 of the driving motor 10. The pump ring, the driving belt and the driving shaft 14 of the engine 10 are located outside the stern of the boat 8. These three elements may easily be encapsulated in a housing 16 as clearly and distinctly is shown in FIG. 4. Consequently one has obtained a very convenient unit to mount at the stern of the boat 8. The pump 11 is on its outside provided with an adjustable outlet nozzle 15 which can be adjusted into different directions, in order to change direction of travel. The speed of the boat is controlled by the pump pressure.

The designation 14A refers to a coupling that joins the outgoing shaft of the driving motor 10 to a driving unit which constitutes the continuation of the shaft over which the driving belt 7 is going to be placed. The driving belt 7 runs further about the external circumference of the pump wheel about a ring which is opposite to the pump wheel hub 6 and between which ring and hub the pump blades 5 are arranged.

Figure 5:
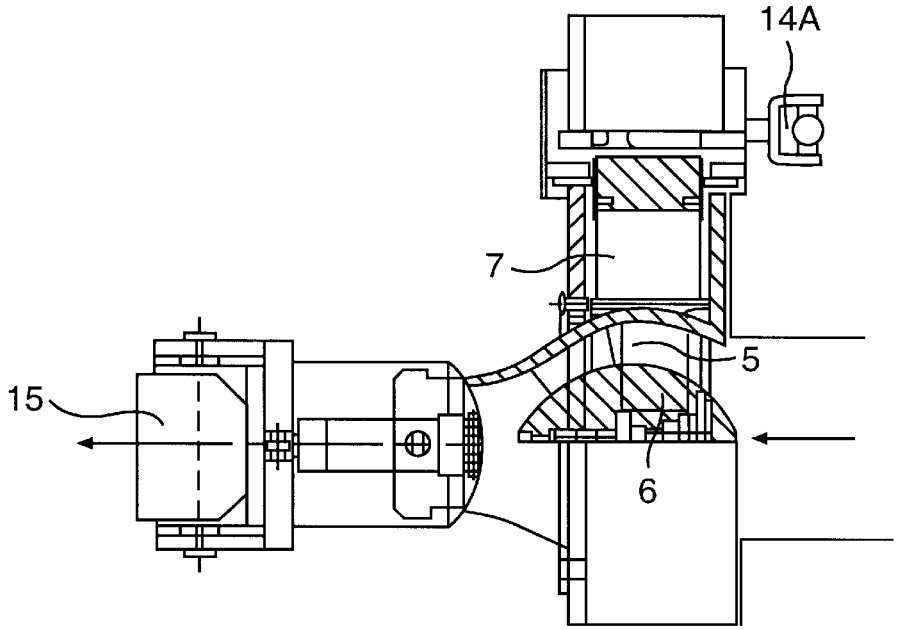
FIG. 5 shows an illustration of a pump with a control nozzle for an emitted water jet.

In FIG. 5 the nozzle is also shown which is utilized for directing the water jet. The nozzle is consequently pivotable partly about a horizontal axis, partly about an axis perpendicular to said axis.

By the use of the arrangement comprising a pulley the speed of the boat without using a gear-box can have its speed controlled continuously. Further there is a great advantage to have a pump ring, a pulley and a driving shaft encapsulated in a single unit since this faciliates service of the driving unit.

I claim:

1. A high speed boat comprising:

a motor, said motor having a drive shaft;

a pump driven by said motor, said pump including:

a pump shaft;

a hub which is rotatably journalled and coupled to said pump shaft;

a peripheral ring disposed on said hub;

pump blades arranged between said hub and said peripheral ring; and an adjustable outlet nozzle;

wherein said pump shaft and said drive shaft are arranged in parallel spaced-apart relation, said peripheral ring being coupled to and driven by said drive shaft to produce a water jet, said adjustable outlet nozzle directing said water jet to steer said boat, the pressure of said water jet controlling the speed of said boat.

2. The high speed boat according to claim 1, wherein said peripheral ring is coupled to said drive shaft by a belt.

3. The high speed boat according to claim 1, wherein said peripheral ring is coupled to said drive shaft by a chain.

4. The high speed boat according to claim 1, wherein said adjustable outlet nozzle is pivotable about at least one of a vertical axis and horizontal axis.

5. The high speed boat according to claim 1, wherein a driving arrangement, comprising a portion of said drive shaft, said peripheral ring, and means for coupling said peripheral ring to said drive shaft, is mounted on the outside of the stern of said boat.

6. The high speed boat according to claim 5, wherein said driving arrangement is at least partly enclosed.

* * * * *